United States Patent [19]

Negri

[11] 3,987,650

[45] Oct. 26, 1976

[54] METHOD OF FORMING THE WAISTBAND IN PANTY HOSE OR SIMILAR ARTICLE AND THE RESULTING PRODUCT

[75] Inventor: Ettore Negri, Florence, Italy

[73] Assignee: Billi, S.p.A., Florence, Italy

[22] Filed: Apr. 4, 1974

[21] Appl. No.: 458,027

[30] Foreign Application Priority Data

Apr. 5, 1973 Italy ..... 9406/73

[52] U.S. Cl. ..... 66/177

[51] Int. Cl.[2] ..... A41B 9/14

[58] Field of Search ..... 66/177, 175, 176

[56] References Cited

UNITED STATES PATENTS

| | | | |
|---|---|---|---|
| 402,202 | 4/1889 | Sutton | 66/177 |
| 2,176,694 | 10/1939 | Tait | 66/173 |
| 2,268,818 | 1/1942 | Goodman | 66/173 |
| 2,356,484 | 8/1944 | Wagenhorst | 66/173 |
| 2,511,720 | 6/1950 | Lacks | 66/177 |
| 2,904,980 | 9/1959 | Stinson | 66/173 |
| 3,670,529 | 6/1972 | Fregeolle | 66/177 |
| 3,673,821 | 7/1972 | Johnson | 66/177 |
| 3,748,870 | 7/1973 | Fregeolle | 66/177 |

FOREIGN PATENTS OR APPLICATIONS

| | | | |
|---|---|---|---|
| 2,182,374 | 7/1973 | France | 66/177 |
| 1,243,506 | 8/1971 | United Kingdom | 66/177 |

OTHER PUBLICATIONS

Goadby, D. R., *Billi's Pair of One-Piece Pantie-Hose*, In The Hosiery Trade Journal, 80(954): pp. 99–100, June 1973.

*Latest One Piece Development at Billi Hosiery Exhibition in Leicester*, In The Hosiery Trade Journal, 79(946): pp. 100–101, Oct. 1972.

*Primary Examiner*—Mervin Stein
*Assistant Examiner*—Andrew M. Falik
*Attorney, Agent, or Firm*—Clifton T. Hunt, Jr.

[57] ABSTRACT

The invention relates to a method for the forming of a continuous tubular one-piece panty hose on a circular knitting machine wherein the waist opening extends transversey of the direction of knitting and the marginal edges of the waist opening are at least partly finished with a tubular welt construction.

7 Claims, 46 Drawing Figures

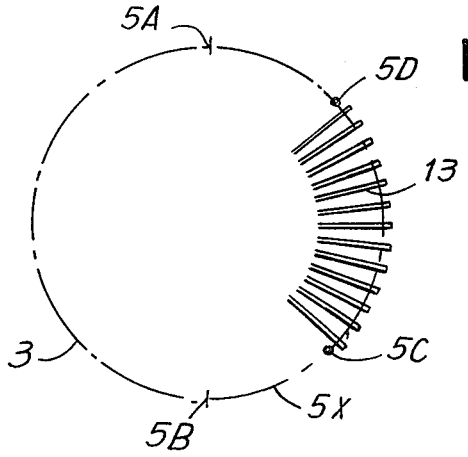
Fig. 4
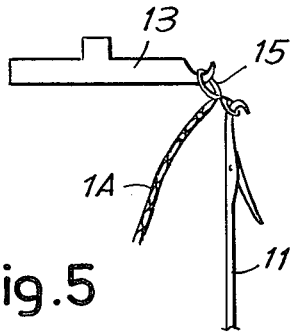
Fig. 5
Fig. 6
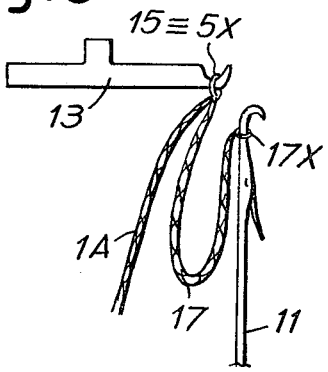
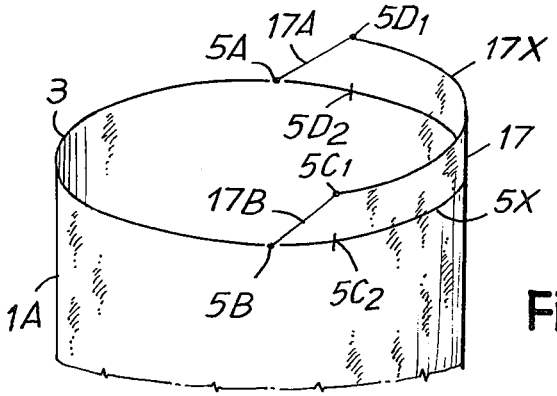
Fig. 7

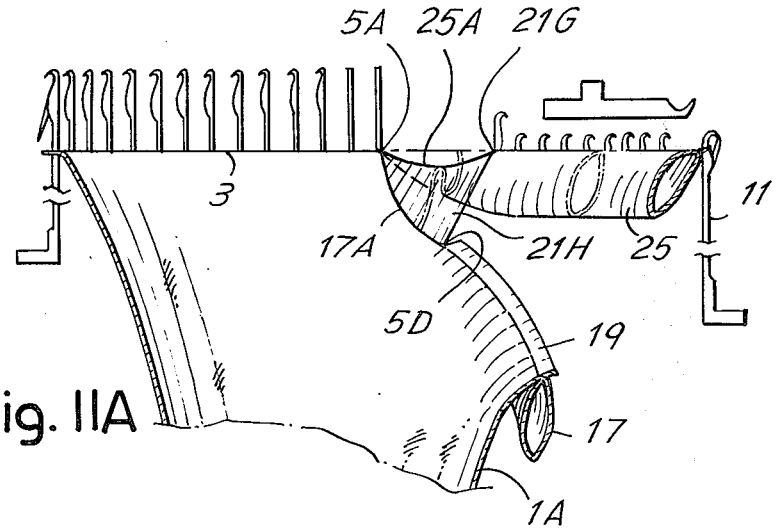
Fig. 11A
Fig. 12A
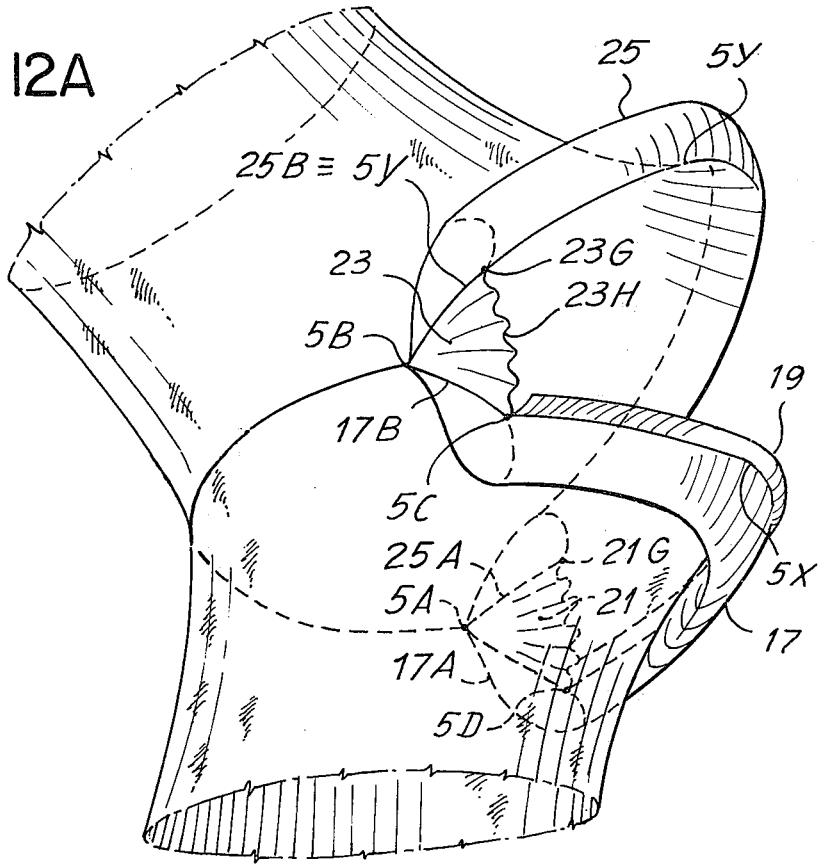

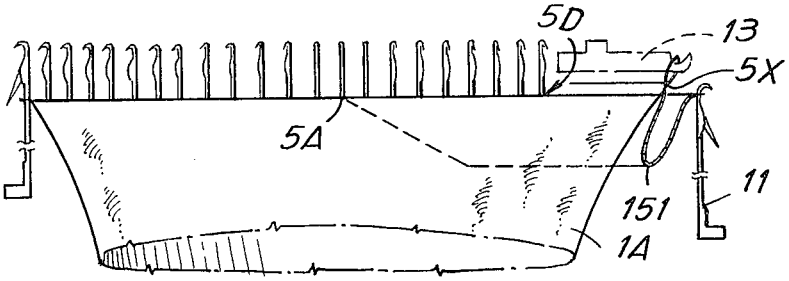
Fig.21
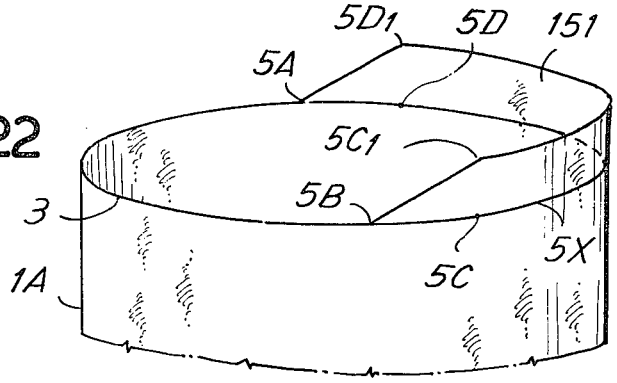
Fig.22
Fig.23
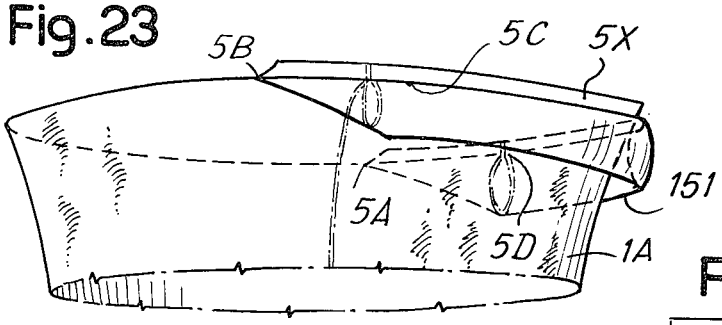
Fig.24
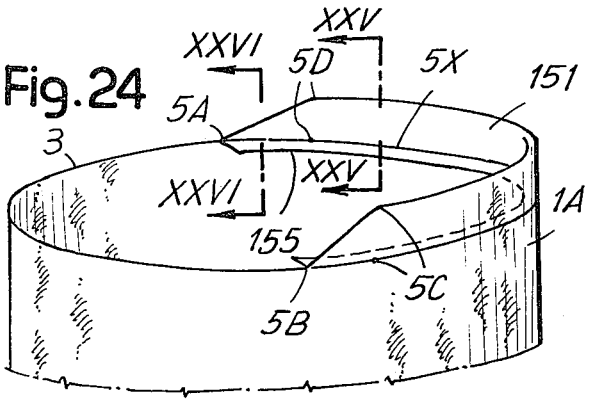
Fig.25
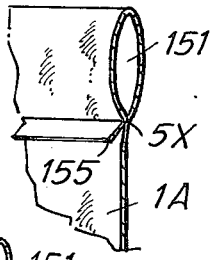
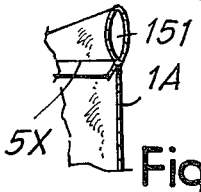
Fig.26

METHOD OF FORMING THE WAISTBAND IN PANTY HOSE OR SIMILAR ARTICLE AND THE RESULTING PRODUCT

BACKGROUND OF THE INVENTION

In the knitting of one-piece panty hose it is conventional to form the waist opening during the knitting operation as described, for example, in U.S. Pat. No. 3,673,821 to Johnson. In most instances the waist opening is defined by a cut or slit extending wale-wise along the knitted fabric, that is in the direction of knitting. This is objectionable because in the finished product the dimension between the waist opening and the crotch is limited by the diameter of the knitting machine, which is generally about four or four and one-half inches.

There have been prior attempts to form the waist opening during knitting on a circular knitting machine in a direction transverse to the direction of knitting or course-wise of the knitted article, but difficulty has been encountered in retaining the stitches bordering the waist opening.

SUMMARY OF THE INVENTION

According to the invention, the marginal edges of the waist opening are formed with a reciprocating motion of the needle cylinder and finished with a pair of tubular welts, each including gradual variations of the length of the courses in corresondence of the ends of the opening.

OBJECTS OF THE INVENTION

It is is an object of the invention to provide a waist opening in panty hose knit on a circular knitting machine and extending transversely of the direction of knitting in order to provide a greater margin of comfort than is possible with openings extending parallel to the direction of knitting.

It is another object of the invention to provide a waist opening in panty hose knit on a circular knitting machine of the type described wherein the marginal edges of the waist opening are at least partially defined by a two-ply fabric or welt-like construction formed on a dial and cylinder machine in a manner similar to the forming of the shadow welt on a conventional stocking.

It is another object of the invention to provide a waist opening in panty hose on a circular knitting machine of the type described wherein each of the plies of the welt at the waist opening is tapered upwardly at the crotch line and joined with desirably dimensioned triangular panels at the front and rear of the waist opening to improve the fit of the garment.

BRIEF DESCRIPTION OF THE DRAWINGS

FIG. 2 is a view similar to FIG. 1 but showing the article partly shaped for the forming of panty hose or the like;

FIG. 4 is a schematic cross section illustrating the operation of the machine at the forming of the waist opening;

FIGS. 5 and 6 schematically illustrate the active members of a needle cylinder in two stages of the forming of the first half of a tubular welt;

FIG. 7 perspectively illustrates the formation of the waist opening after the knitting of the first ply of the tubular welt;

FIG. 11A is a view similar to FIG. 11 but illustrating the condition of the fabric after the second tubular welt has been taken from the dial hooks;

FIG. 12A is a view similar to FIG. 12 but showing the waist opening in partially extended position from the position shown in FIG. 12;

FIG. 21 is a schematic sectional view of portions of a knitting machine illustrating the forming of the finishing welt according to a third embodiment of the invention;

FIG. 22 is a perspective illustration of the article knit according to FIG. 21 and in an extended condition;

FIGS. 23 and 24 are perspective illustrations of the article after the forming of a first tubular welt at the waist opening;

FIGS. 25 and 26 are simplified sectional views taken substantially along the lines 25—25 and 26—26 in FIG. 24;

DETAILED DESCRIPTION OF THE INVENTION

Figure 1:
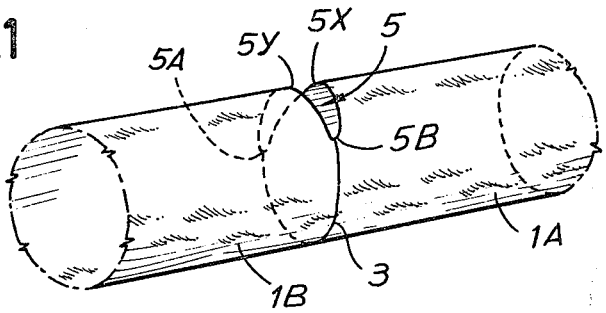
FIG. 1 is a perspective view of the medial portion of a tubular article, such as a one-piece panty hose, with portions of the legs broken away and illustrating the location of a transverse opening to form the waist line of the completed garment.
Figure 2:
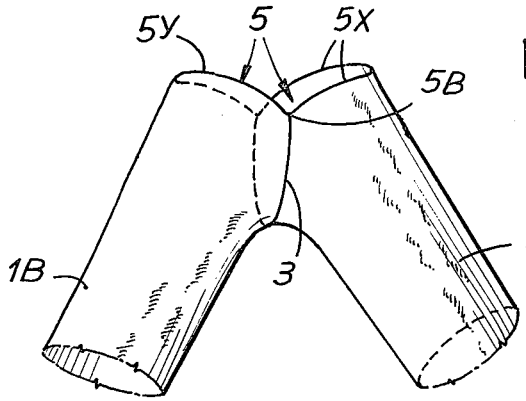

Referring more specifically to the drawings, the first embodiment of the invention shown in FIGS. 1 through 17 includes two contiguous and adjoining tubular portions 1A and 1B which may correspond to the leg portions of panty hose. The line 3 denotes the upper extremity of each tubular portion 1A and 1B and corresponds to the crotch line in the completed panty hose. In correspondence of the line 3, a transverse opening, generally indicated at 5 in FIGS. 1 and 2, is formed and developed to constitute the opening for the waist line of the garment. The transverse opening may extend about approximatley one-half the circumference of the tubular fabric. The lines 5X and 5Y indicate the marginal edges of the waist opening. These edges extend parallel to the courses of stitches and must be finished to prevent stitch deterioration in use. It is the finishing of the edges 5X and 5Y with which this invention is particularly concerned. The points 5A and 5B at opposite ends of the crotch line 3 are characteristic and critical points of the edges 5X and 5Y.

Figure 3:
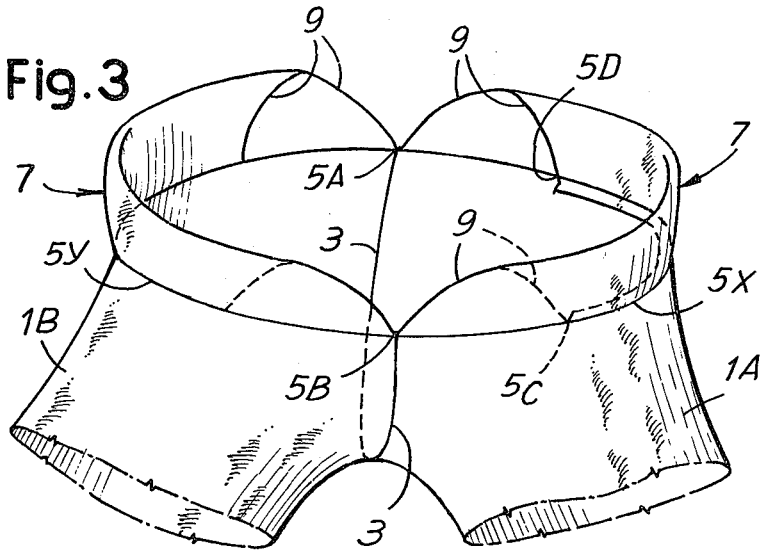
FIG. 3 is a perspective view of the medial portion of the garment shown in FIG. 2 and illustrating the construction of the fabric defining the waist opening according to a first embodiment of the invention, more fully shown in FIGS. 4 through 17.
Figure 8:
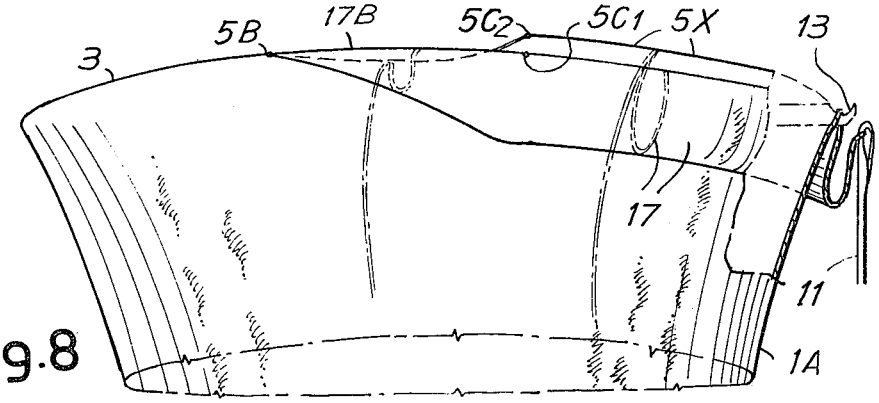
FIGS. 8, 9 and 10 are views similar to FIG. 7 illustrating sequential stages of the forming of said first tubular welt.

In a first embodiment which is briefly and partly shown in FIG. 3, the waist opening has at each side a tubular welt 7, whose ends are inclined as shown at 9 by gradual reductions of the courses of the fabric from which the welts 7 are formed, it being undestood that the courses are parallel with the edges 5X understood 5Y of the opening side. If the embodiment were kept under the conditions shown in FIG. 3, the points 5A and 5B would appear as single points and particularly stressed in the worn garment because the points 5A and 5B are the terminal points of the crotch line 3. In order to avoid the concentration of the stresses due to the tensioned welts 7, there is provided a direct or indirect connection between the inclined edges 9. This may be obtained by connecting the edges 9 with one another through portions of the triangular fabric, or connecting the edges 9 to the fabric of the article along the edges 5X, 5Y.

Figure 14:
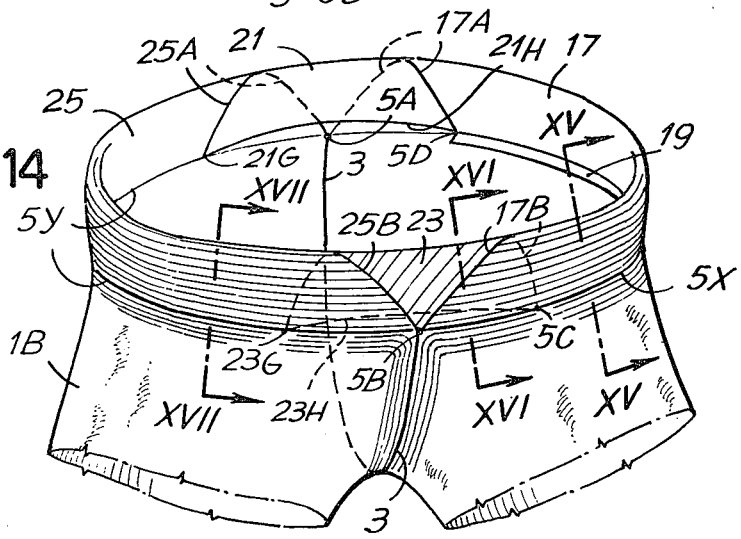
Figure 15:
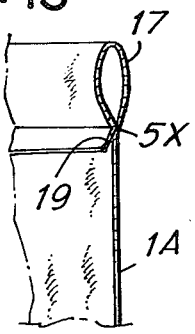
FIGS. 15, 16 and 17 are simplified vertical sectional views taken substantially along the lines 15—15, 16—16, and 17—17 in FIG. 14.
Figure 16:
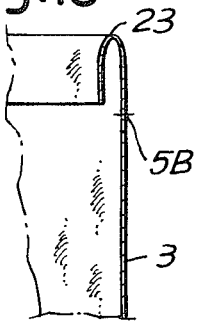
Figure 17:
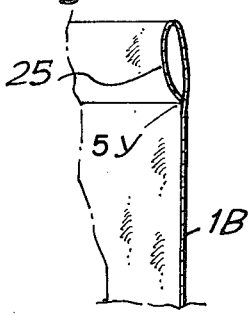

FIG. 14 is a view similar to FIG. 3 but showing a solution in which arrangements are provided designed to improve the article by the knitting of auxiliary triangular fabrics or panels. This is the solution which is described initially.

With reference to FIGS. 4 to 17, after the knitting of the first tubular portion or section 1A and after completion of its terminal course in correspondence of the crotch line 3 and the first edge 5X of the opening 5, the continuous circular motion of the needle cylinder is interrupted and reciprocal knitting begins along the arc 5X to form the first flap or ply of the first or right hand welt 7 in FIG. 3.

The machine for the knitting of the article is a substantially conventional circular knitting machine conventionally used for knitting stockings and panty hose and capable of a continuous circular motion of the needle cylinder or of a reciprocating motion of the needle cylinder and provided with retaining means for the stitches such as the conventional hooks 13 which are assembled on a grooved disc rotating coaxially and synchronically with the needle cylinder and conventionally used to form the double end welt or shadow welt of ladies stockings. The hooks operation is well known, for instance, in U.S. Pat. No. 1,282,998 to Scott and in Italian Pat. No. 572,609 and 572,829 to Scott and Williams.

The machine used in carrying out the invention is equipped with cams and with control means for the selection of needles and hooks, all of which is fully conventional. The machine is also equipped with devices for excluding single needles or groups of needles from work by raising and for reinserting single needles or a group of needles into work by lowering as at the end of an active arc of needles. Devices of this kind to include and exclude needles are sometimes known as "pickers" and are illustrated, for instance, in U.S. Pat. No. 3,269,148 to Millar, in British Pat. No. 1,027,327 to Eppinger, in German Pat. No. 1,206,674 to Scott & Williams, and in Italian Pat. No. 582,628 to Scott & Williams.

Immediatelly before ceasing the continuous circular knitting by which the tubular fabric 1A if formed, the dial hooks 13 are extended along the arc defined by the points 5C and 5D in FIG. 4 in order to engage the fabric along the line 5X. The arc 5C–5D is intermediate, smaller and symmetrical with respect to the arc defined by the points 5A and 5B and opposite the arc defined by the line 3. The yarn is seized by the hooks 13 projecting into the arc 5C–5D, and the fabric 1A is thus suspended from the hooks 13 as shown at 15 in FIG. 5. After this operation, reciprocal knitting is carried out initially along the arc 5A-5D-5C-5B while the needles in the arc 5B-3-5A are raised to inactive position. The inactive needles along the arc 5B-3-5A remain excluded from work until the cylinder resumes continuous circular knitting to form the tubular section 1B.

A flap or ply of fabric 17 is formed by reciprocal knitting as an extension of the edge 5X corresponding to an arc of the terminal course of the tubular section 1A and defines a first ply of the tubular welt to be formed. The flap 17 (FIGS. 6 and 7) is initially formed on the arc along the line 5X between the points 5A and 5B, and by gradually decreasing the number of active needles with the aid of the "pickers" device. The completed flap 17 is tapered end portions 17A and 17B which are then engaged by the inactive needles lying in the arc 5A-5D and 5B-5C, respectively. The tapered end portion 17A is developed from the point 5A to the point $5D_1$ and the tapered portion 17D is developed from the point 5B to the point $5C_1$ (FIG. 7). At this point, there is a pocket formed by the flap 17 as shown in FIG. 6 and shown in extended position in FIG. 7. The tubular fabric 17 is engaged to the hooks 13 along the arc 5C–5D in FIG. 4 which corresponds to the arc $5C_2$–$5D_2$ in FIG. 7. The terminal course 17X of the flap 17 (FIGS. 7 and 8) is engaged to the needles along the arc 5C–5D. At this point, the fabric engaged by the hooks 13 is brought back onto the needles and the edges 5X and 17X are connected between the points 5C and 5D (See FIG. 8). A partial tubular welt 17 is thus formed, after which reciprocal knitting continues to form a small lip or anti-ravel tab 19 along the arc 5C–5D to prevent the formation of ladders or runs after the fabric is cast off the needles in the usual way by interrupting the feed of the yarn, raising the needles to clear them, and relowering them.

Figure 9:
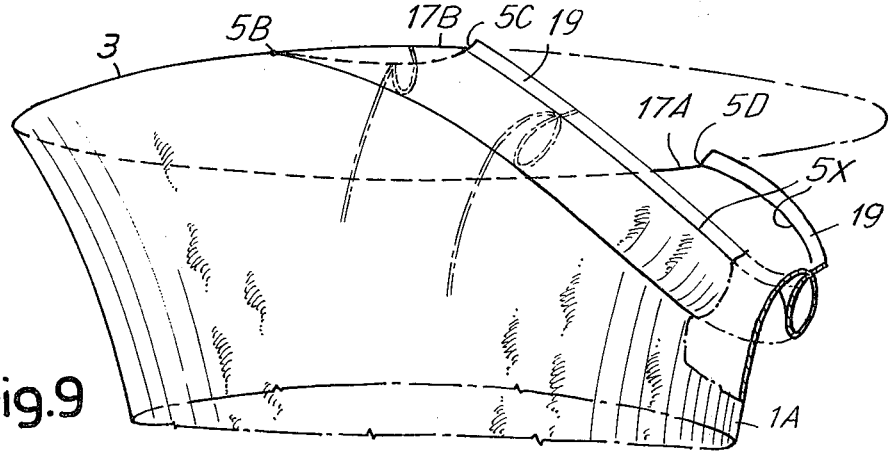
Figure 10:
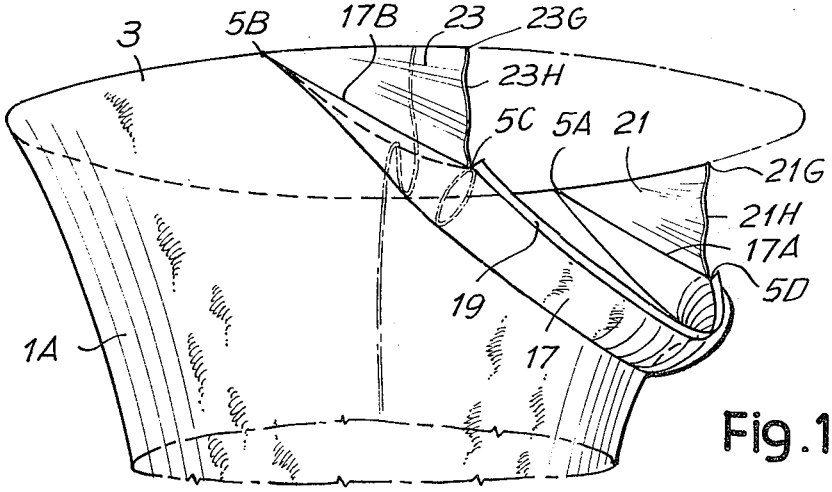

At this point, the article is supported along the arc 3 between the points 5A and 5B by the inactive needles raised out of operation. Similarly, the article is engaged by needles raised out of work along the arc 5A–5D and 5B–5C, while along the arc 5C–5D the needles are free from the fabric (FIG. 9).

Figure 13:
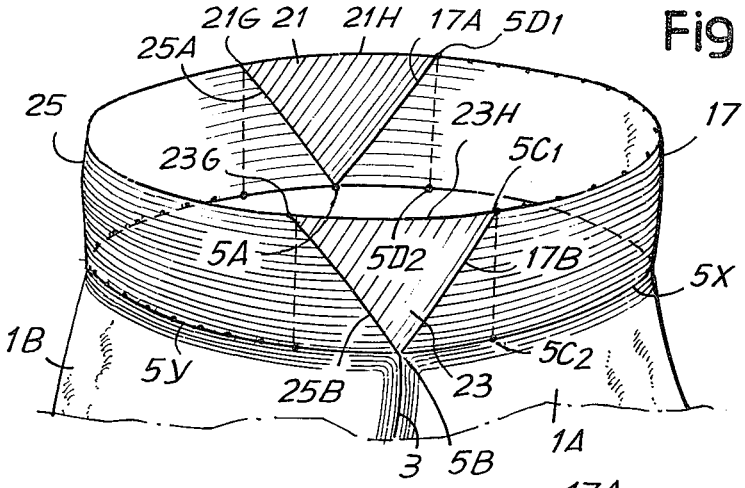
FIGS. 13 and 14 perspectively illustrate the array of the waist opening with the tubular welts in extended condition for purpose of clarity in understanding the invention.

Next, a triangular fabric 21 is formed by reciprocal knitting on the needles along the arm 5A–5D, and with the gradual withdrawal of needles beginning from the point 5A up to the point 5D and extending toward an apex 21G of the triangular fabric 21. FIG. 13 illustrates the array of the completed waist portion and illustrates the positioning of the triangular fabric 21. One edge of the triangular fabric 21 is defined by the tapered marginal edge 17A of flap 17.

Similarly, and subsequent to the forming of triangle 21, or simultaneously therewith, there is formed a fabric traingle 23 on the needles extending along the arc 5B–5C extending from the tapered marginal edge 17B of flap 17. The triangular configuration is obtained by a gradual withdrawal of needles as described in connection with the making of triangular fabric 21. The forming of the two fabric triangles 21 and 23 is more fully explained by stating that the withdrawal of active needles is obtained by the progressive exclusion of the needles starting from the point 5A toward the point 5D and respectively starting from the point 5B toward the point 5C during reciprocating knitting. Accordingly, courses are formed by removing one or more needles in each course from the end nearest the point 5B while each course extends to the needle at point 5C. In the several courses the needle at 5C forms the stitches of the edge 23H. A pattern of needle withdrawal is so arranged as to enable a substantial extension of the fabric triangles in the direction toward their respective apexes 21G and 23G. After the two triangle panels 21 and 23 are formed, the article is engaged by the needles raised to the inoperative position along the arc defined by the point 5D (which corresponds to the point 21G) - 5A-3-5B-5C (which correspond to the point 23G). The needles along the arc 5D-5C are on the contrary cleared and free, and in a lowered operative position. The apexes 21G and 23G are located in correspondence of the points 5D and 5C.

The first tubular welt 17 is thus completed and the triangular fabrics 21 and 23 are formed in preparation for the forming of the second tubular welt along the edge 5Y which is yet to be formed. In order to form the tubular welt along the edge 5Y, reciprocal knitting is continued on the needles along the arc 5C–5D to form a makeup.

While the cylinder rotates to make the first course, the needles are selected 1 × 1, supplying the starting yarn with the odd numbered needles actively taking the yarn and the alternate needles out of action and not taking the yarn. Those needles along the arc 5C–5D which do not take the yarn, pass low. A first course is thus formd and thereafter a course is formed by knitting on all the needles along the arc 5D-5C so as to form the classic initial selvedge. The two makeup courses thus formed are transferred onto the dial hooks 13 (FIG. 11) in a known way and a flap or ply of fabric 25 is formed with the needles 11 to provide one ply of the tubular welt for the edge 5Y.

Figure 11:
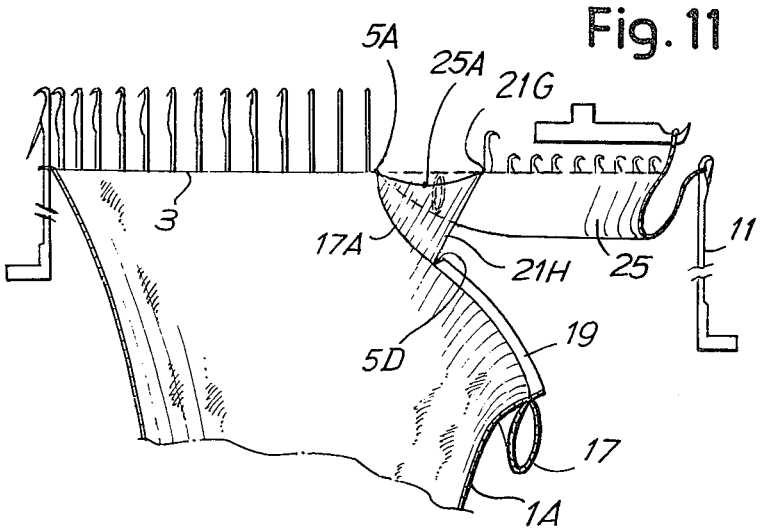
FIG. 11 is a view similar to FIG. 6 but illustrating the forming of a second tubular welt.
Figure 12:
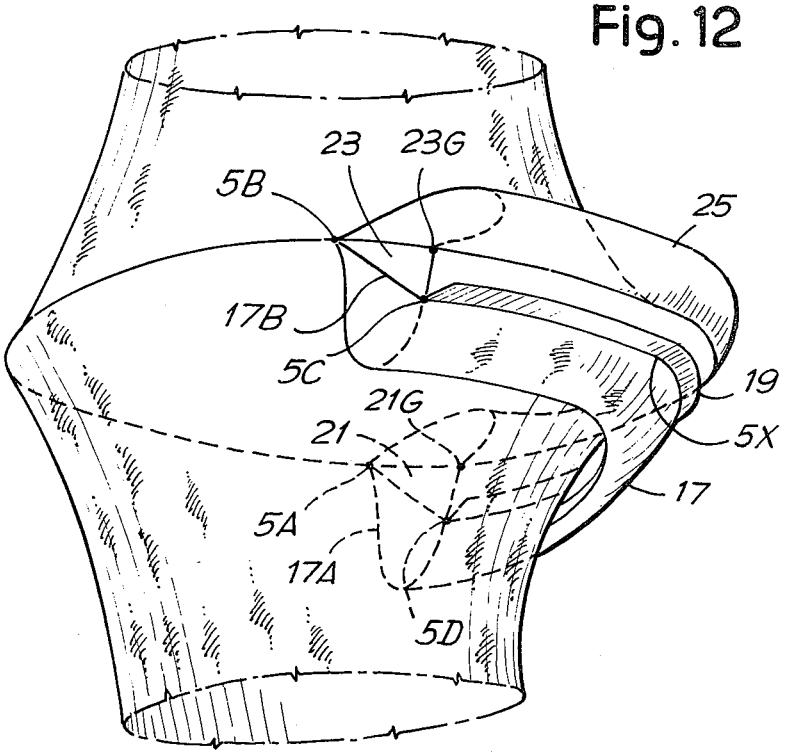
FIG. 12 is a view similar to FIG. 10 illustrating the forming of the second tubular welt and illustrating the construction of the waist opening in relation to the adjoining portions of the garment in a schematic manner.

The flap or panel 25 is formed by gradually increasing the needles to progressively include the needles along the arcs 5D-5A and 5C-5B, starting from the points 5C and 5D toward the points 5B and 5A respectively (FIG. 4) to form the tapered marginal edges 25A and 25B of the panel 25. Correspondingly the marginal edges 25A and 25B are gradually connected to the triangular fabric 21 and 23 along the sides 21G-5A and 23G-5B thereof. The tapered marginal edges 25A and 25D terminate, after the panel 25 is formed, at the points 5A and 5B, respectively, and the same tapered edges 25A, 25B are gradually connected with the sides 21G-5A and 23G-5B of the fabric triangles 21 and 23. The terminal course of the panel 25 at the joining of the points 5B and 5A corresponds to the edge 5Y of the opening 5. The terminal course of the panel 25 is engaged by all the needles along the arc 5B-5C-5D-5A, and the initial course of the panel 25 is brought back to these needles after having been retained by the hooks 13 (FIG. 11). After the relocation of the flap 25 onto the needles and then after the forming of the tubular welt, reciprocal knitting ceases and the continuous circular knitting is resumed to form the second tubular section 1B, beginning along the line 3 and the line 5Y in FIGS. 13 and 14.

In FIGS. 13 and 14, the thin parallel lines indicate the sequence of knitting successive panels as the article is formed progressively along the front of needles.

The waist opening is finished along the edges 5X and 5Y of the opening 5 by the tubular welts 17 and 25, and is finished about the points 5A and 5B by the triangular fabric panels 21 and 23 which join the tapered marginal edges 17A, 25A and 17B, 25B, respectively, of welts 17 and 25.

THE SECOND EMBODIMENT

Figure 18:
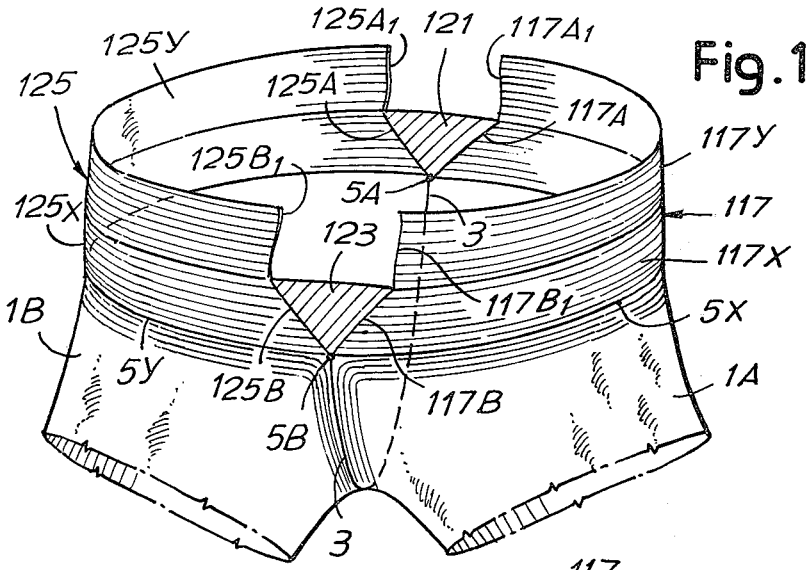
FIGS. 18 and 19 illustrate a second embodiment of the invention but are views similar to FIGS. 13 and 14.
Figure 19:
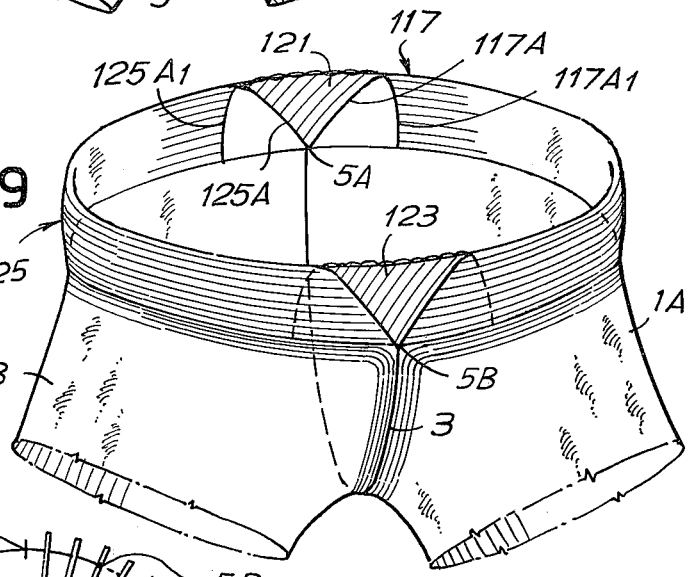

FIGS. 18 and 19 illustrate an embodiment wherein the extension of the joining triangular fabrics are reduced with respect to the previous embodiment. In FIGS. 18 and 19 the article is represented under the same conditions as the article of the previous embodiment is shown in FIGS. 13 and 14. In FIGS. 18 and 19, the same reference characters are applied to the same elements with the reference characters in FIGS. 18 and 19 being increased by 100.

The welt 117, corresponding to the welt 17, is formed from two plies 117X and 117Y of substantially equal length. The ends of the portion 117X are indicated at 117A and 117B and are tapered as the portion 117X is formed with a gradual withdrawal of the needles along the needle front. The ends of the portion 117Y are indicated by $117A_1$ and $117B_1$ and are straight instead of being tapered, all of the needles being maintained during the forming of the portion 117Y. Portion 117Y is knit after portion 117X and portion 117Y is knit only on the needles remaining in action after the desired amount of needles have been withdrawn from action to form the tapered edges 117A and 117B. Accordingly, the end edges $117A_1$ and $117B_1$ of portion 117Y extend vertically from the upper ends of tapered lines 117A and 117B.

The welt 125, corresponding to the welt 25, is formed in a similar manner to two portions 125X and 125Y, the portion 125X having the tapered marginal edges 125A and 125B and the portion 125Y having straight ends $125A_1$ and $125B_1$. Fabric triangles 121 and 123 extend between the portions 117X and 125X only and are joined thereto along the tapered ends 117A, 125A and 117B, 125B.

The embodiment of FIGS. 18 and 19 provides a smaller finish of the edge along the waist opening and zone of the free chain edges of the triangular fabrics 121 and 123 but a higher speed of production is possible as the triangles 117 and 125 are formed with a smaller number of courses than the triangles 17 and 23 of the previous embodiment. The time required for producing the triangular fabric is accordingly reduced. In the embodiment of FIGS. 18 and 19, the triangles 121 and 123 are not folded on themselves as occurs in the first embodiment and as most clearly seen in FIG. 14.

The embodiments hitherto described with reference to FIGS. 1 to 19 (with the exclusion of FIG. 3) have as their object the use of triangular fabrics for the purpose of distributing the tensioning stresses resulting from the elastic expansion of the edges of the opening along the waist line, thus distributing the stresses amongst a remarkable number of stitches. A secondary but important function of these bridging triangular fabrics is that of increasing the extension of the crotch line 3, which is obviously enlarged because of the presence of the fabric triangles 17,23 and 117,123 by an amount corresponding to twice the height of the finishing welt.

In the embodiments thus far described the auxiliary triangular panels 21,23 and 121,123 function to connect the tubular welts 7 of FIG. 3 by being joined to the end edges of the welts such as shown at 9 in FIG. 3.

In FIGS. 20 through 32, the connection of the welts 7 in FIG. 3 is obtained indirectly through the connection of the tapered ends directly on the fabric along the edges 5X,5Y the welts being reduced in section to the point of disappearing at the points 5A,5B.

In the embodiment of FIGS. 20 through 32, the first tubular portion 1A is knit with continuous circular motion of the needle cylinder until the terminal course indicated by the crotch line 3 and the arc 5X corresponding to the right side of the waist opening in the drawings. At the end of the continuous circular motion by which the tubular portion 1A is formed, the hooks 13 are radially projected to engage the fabric along the arc 5X between the points 5A and 5B. Subsequently, the needles along the arc defined by the line 3 between the points 5A and 5B are put out of operation by being raised to inoperative position. Knitting with a reciprocal motion on the remaining needles 11 is commenced to form a first length or pocket of fabric 151 in correspondence of the arc 5A–5D, 5C-5B. The points 5D and 5C are spaced from the points 5A and 5B, respectively, along the arc 5X in FIG. 22. The pocket 151 in FIG. 21 is destined to become a tubular welt 203 (FIG. 32) and immediately after the starting of the welt 203, the needles at the ends of the arc 5X are gradually excluded by being raised starting from the points 5A and 5B to the points $5C_1$ and 5D1. Thus the pocket 151 is made with its height gradually increasing from the end points 5A,5B to the points $5C_1,5D_1$ (FIG. 22). The edge 5X is then transferred along the arc between the points 5A and 5B from the hooks to the needles, thus connecting the pocket 151 to form a tubular welt 203.

In order to join the stitches along the course 5X to the terminal end of the flap 151, the needles along the arc 5A–5D and along the arc 5B-5C are lowered to operative position for a half rotation of the needle cylinder letting them resume knitting under the same conditions as the needles lying in the arc 5D-5C. In the intermediate zone between the points 5C and 5D the tubular welt formed with the flap 151 has a constant and uniform dimension which decreases toward the ends of the welt between the points 5C and 5B and between the points 5D and 5A, the two-ply fabric of the welt terminating in a single ply at the terminal points 5A and 5B.

After the stitches along the course 5X are transferred from the hooks to the needles along the arc 5A-5D-5C-5B, the needles included in the arc 5P-5D-5C-5Q (FIG. 32) form an anti-ravel tab 205 with which ladders or runs are avoided, after which the fabric is cleared from these needles. The points 5P and 5Q are located closely adjacent respective points 5A and 5B, and they are selected to establish a connection zone between the two tubular welts along the edges 5X and 5Y of the opening 5, the correspondence of which zone the stresses are distributed, as will now be explained.

Figure 32:
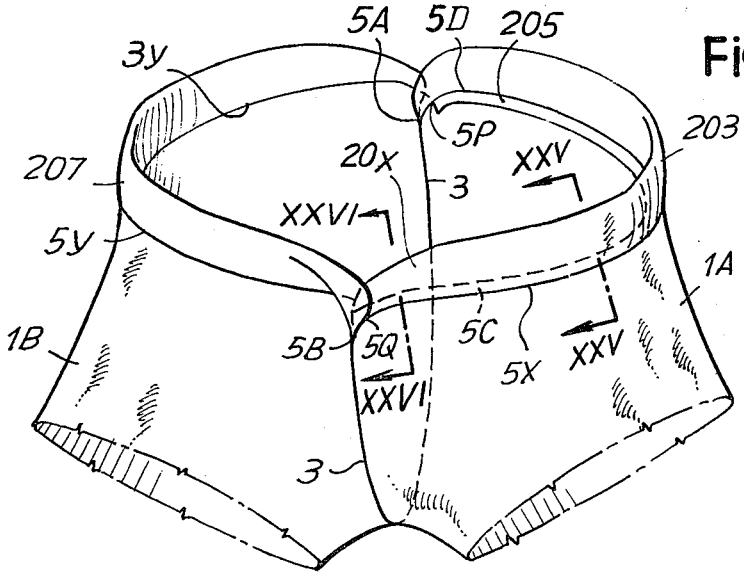

After the anti-ravel 205 has been cast off the needles along the arc 5P-5D-5C-5Q, a makeup course is formed on the same needles and they are put into knitting action along with the needles in the relatively short arcs 5A-5P and 5Q-5B to knit by a reciprocal motion the fabric for the second tubular welt 207 along a front corresponding to the line 5Y in FIG. 32. The seizing of the initial stitches along the front corresponding to the line 5Y by the hooks 13 is repeated on the entire arc 5A-5P-5D-5C-5Q-5B and the operation proceeds with a reciprocating motion to form a tubular welt 207 similar to the tubular welt 203 and with progressive withdrawal of needles to decrease the length of the courses correspondingly with the amplitude of the needle arc from the point 5A to the point 5D and from the point 5B to the point 5C. After a suitable length of fabric has been formed the stitches retained on the hooks 13 are transferred to the needles 11 along the whole arc 5A-5P-5D-5C-5Q-5B, thus obtaining a tubular welt 207 which has a major uniform dimension at its medial portion between the points 5C and 5D and is gradually reduced by tapering its ends in the manner previously described.

At this point, knitting with a continuous circular motion is resumed on the front comprising the crotch line 3 and the waist line 5Y to knit the second tubular portion 1B.

Figure 29:
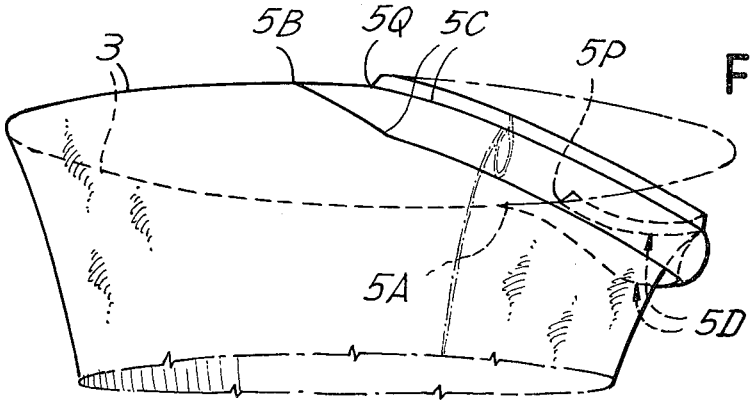
FIGS. 29, 30, 31 and 32 illustrate a variation of an embodiment after the forming of the first welt, during the forming of the second welt, and after both welts have been completed about the waist opening.
Figure 30:
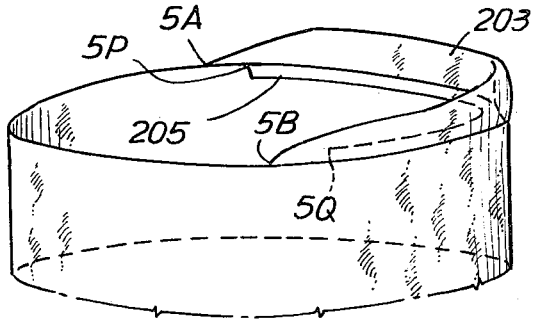
Figure 31:
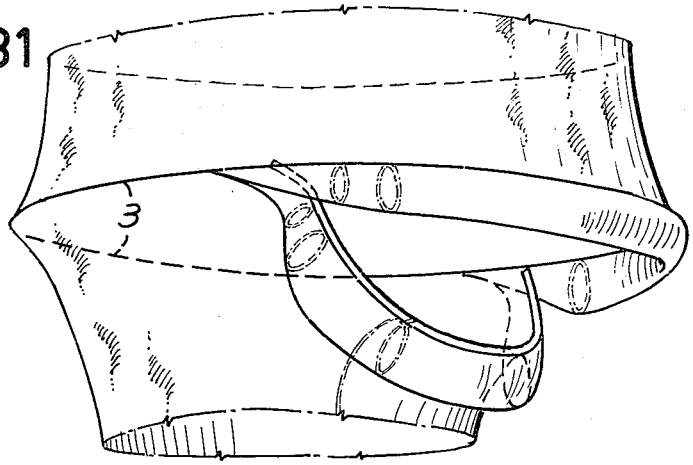

It is to be noted that the lengths 5B–5Q and 5A–5P remain in common i.e. are connected to each other at the respective concurrent ends of the two tubular welts 203 and 207 in FIGS. 29, 30 and 32. Therefore, in practice, all the stitches along these arcs will participate in the resistance to traction or stress between the edges 5X and 5Y. This will be so even if the strain should be concentrated in the points 5P and 5Q.

In this structure, a simplified waist band is provided without any increase in the height of the crotch line 3, and this is so even lacking the triangular fabrics of the previous embodiments. It is important to understand that the length of the arcs 5A-3-5B and 5A-5D-5C-5B can be changed as required to provide garments of different sizes and thereby accommodate the requirements of the intended wearer respecting the waist line 5X-5Y and the crotch line 3.

OTHER EMBODIMENTS

Figure 20:
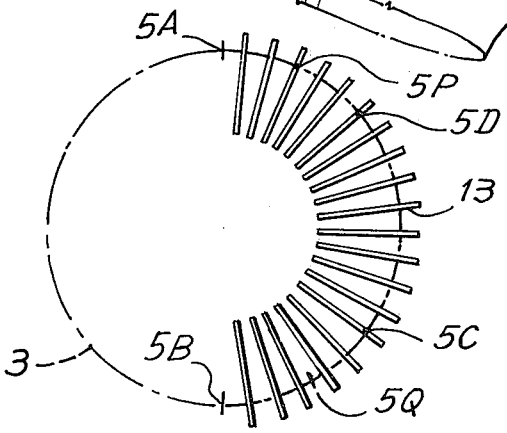
FIG. 20 is a view similar to FIG. 4 but illustrating the arrangement for forming the second embodiment.
Figure 23X:
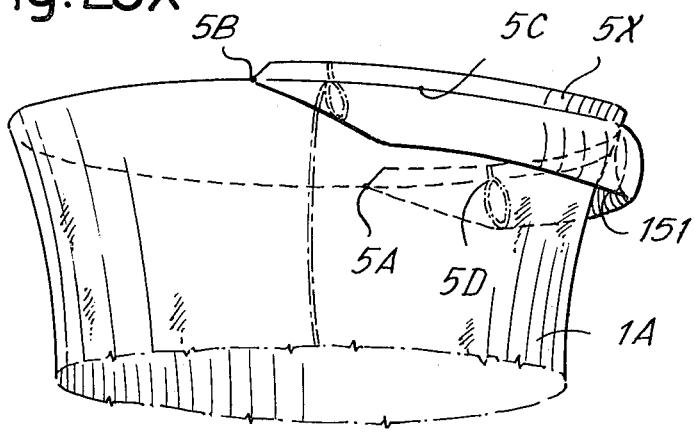
FIG. 23X is a view similar to FIG. 23 but showing the appearance of the flap just prior to transfer of the stitches from the dial hooks to the cylinder needles.
Figure 27:
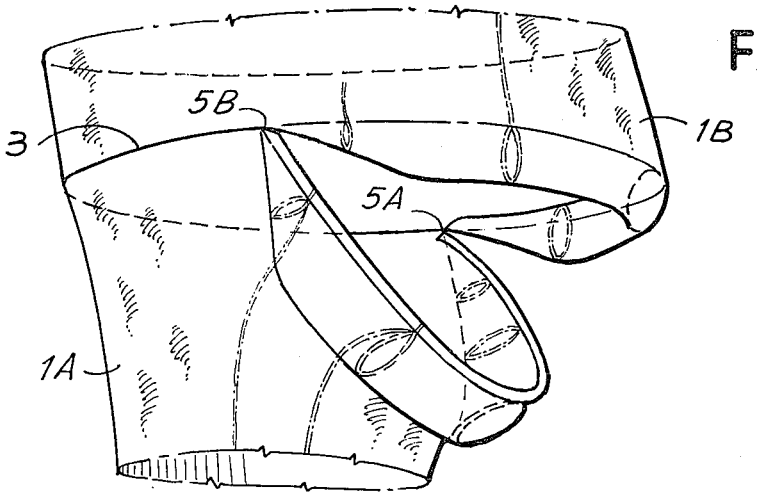
FIGS. 27 and 28 are perspective views illustrating the article during and after the forming of the second tubular welt at the waist line.
Figure 28:
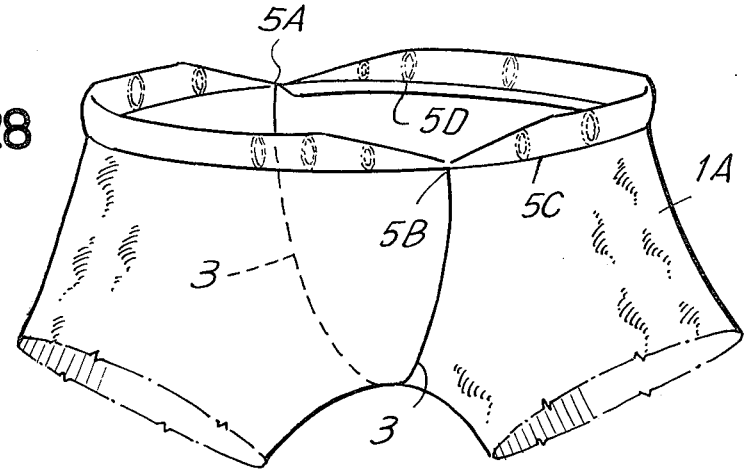

FIGS. 33 to 41 show other forms of embodiment similar to that of FIG. 20 et seq.

Figure 33:
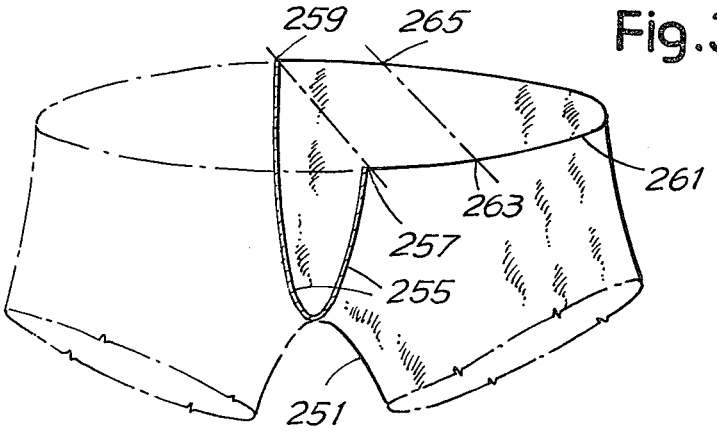
FIGS. 33, 34 and 35 schematically illustrate according to a variation of an embodiment, an article being formed and two successive stages of making a first welt with the fabric extended for purposes of illustration and with the two-ply fabric extended in FIGS. 34 and 35 for a better understanding.

Referring first to FIG. 33, a tubular fabric 251 is first knit with a continuous circular motion of the needle cylinder, after which the needles along the arc 255 between the points 257 and 259 are raised out of action, and the first ply of a tubular welt, tapered at the ends, is begun along the working front 261 between the points 257 and 259. Said working front also includes the points 263 and 265. The initial course along the arc 261 is moved to the hooks 13 of FIG. 6 to support the fabric and to form a pocket such as at 17 between hooks and needles. In this way, according to FIGS. 34 and 35, courses of stitches are developed between the two points 257 and 259, after which courses of stitches are gradually reduced in length by the progressive withdrawal of the end needles starting from the points 257 and 259 toward the points 263 and 265, respectively. After having formed a first zone of fabric 267A (FIGS. 34 and 35) and having reached with minimum width of courses of subsequent stitches between the points 263 and 265, the forming of an additional zone 267B takes place with gradually increasing courses of stitches resulting from a subsequent activation of needles from the point 263 toward the point 257 and from the point 265 toward the point 259. The fabric along the arc 261 between the points 257 and 259 (FIG. 33) is retained on the hooks and the fabrics 267A and 267B are made like a pocket. However, in FIGS. 34 and 35 they are illustrated in extended condition for illustrative purposes only and in an effort to provide a better understanding of the invention. After knitting of the terminal course 269 between the points 257 and 259, the stitches are moved from the hooks to the corresponding needles in such a manner as to close the tubular welt 271 (most clearly seen in FIG. 36) and to then form an anti-ravel tab 273 along a partial arc with respect to the arc 269. The partial arc may have the same length as the arc 261 between the points 263 and 265, along which variations of the arcs of working needles have been effected to correspondingly affect the courses of stitches of the portions 267A, 267B (FIG. 35). The final anti-ravel tab 273 is knit between the points 263B, 265B which correspond to the points 263 and 265.

Next, two triangular fabrics 275, 277 (FIG. 37) are formed by reciprocal knitting on the needles between the points 257 and 263 (for the triangle 275) and with the needles between the points 259, 265 (for the triangle 277). The two triangles may be formed simultaneously or in separate knitting operations, as desired. The triangle 275 is formed by progressively excluding needles from the point 257 toward the point 263 and by forming one edge with a chain stitch 279 defined by the same needle in the position 263, starting from the point 263B (FIG. 36) to the apex 281. The additional side 283 between the point 257 and the point 251 presents stitches which are supported by the needles gradually put out of action by being raised. Also, the triangle 277 is formed in a similar way and thus presents a side formed by a loop edge 285 from the point 265B to an apex 287, while the side 289 between the point 259 and apex 287 is formed by stitches which remain in engagement with the needles progessively put out of action by raising. At the end of the forming of the two triangular fabrics 275, 277 needles are out of operation and retaining the fabric along the arc 281, 283, 257, 259, 289, 287. The needles along the arc 281, 287 (which have cleared the anti-ravel tab 273) are discharged and are free.

At this point, the needles along the arcs 257, 283, 281, and 259, 289, 287 are again put into action and simultaneously the fabric is started with the needles in the arc 281, 287, previously released. A second tubular welt 291, symmetrical to the welt 271 after first activating the hooks to receive the stitches along the whole arc between the points 257, 281, 287, 259 to form a pocket fabric as previously described in connection with the fabrics 267A, 267B, and then clearing the hooks to close the welt 291 which is tapered similarly to the welt 271. Finally, the second tubular fabric 293 is formed by a continuous circular motion working from the line 255 and from the line 295 which are, respectively, the connecting and terminal courses of the welt 291.

Figure 38:
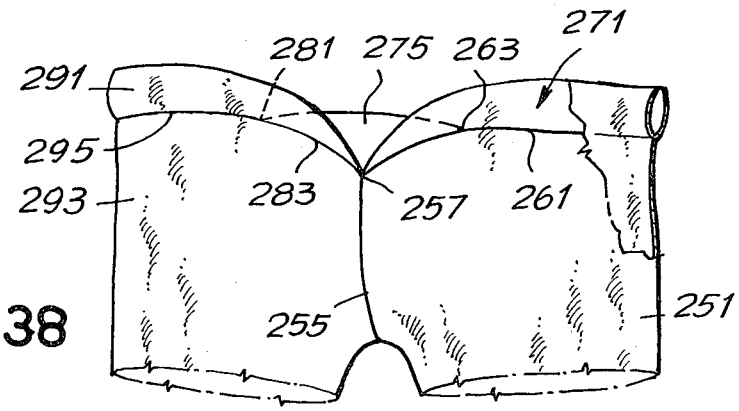

Thus, the article shown in FIG. 38 is obtained.

Figure 39:
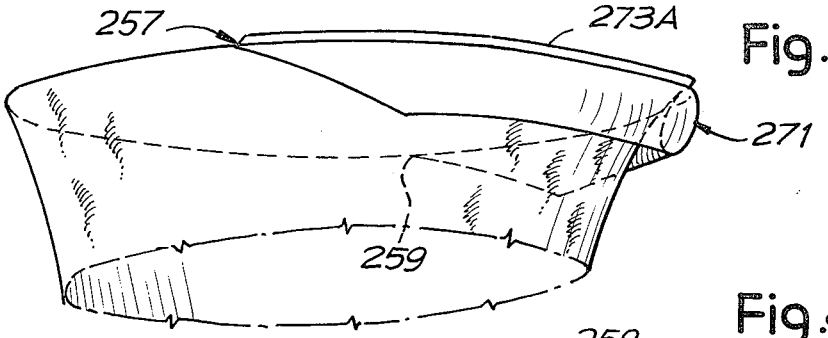
FIGS. 39 and 40 are views similar to FIGS. 36 and 38 but showing a variation of an embodiment.
Figure 40:
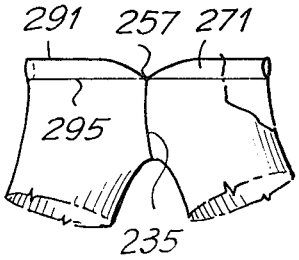

According to the variation of FIGS. 39 and 40, the article is knit as previously described except the fabric triangles 275 and 277 are omitted. In describing the embodiment in FIGS. 39 and 40, the same reference characters are used to identify elements corresponding to those of the embodiment of FIGS. 33 to 38.

After having finished the tubular welt 271, a final flap 273A is formed between the points 257 and 259 instead of between the points 263B, 265B. Immediately afterwards the fabric is started on the needles from which the anti-ravel tab 273A was cast off. Said fabric serves for the forming of the welt 291 (FIG. 40). Welt 291 is shaped like the welt 271 with tapered end portions which become single ply fabric at the points 257, 259. The article assumes the appearance shown in FIG. 40 which is similar to that of the article shown in FIG. 38, except for the absence of the triangular fabric panels 275, 277.

Figure 34:
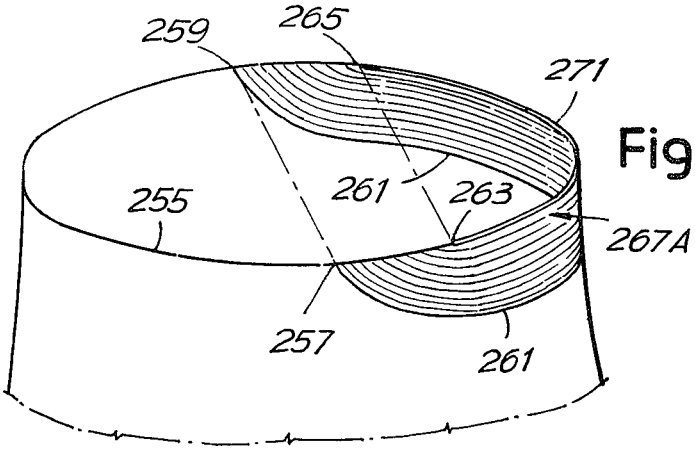
Figure 35:
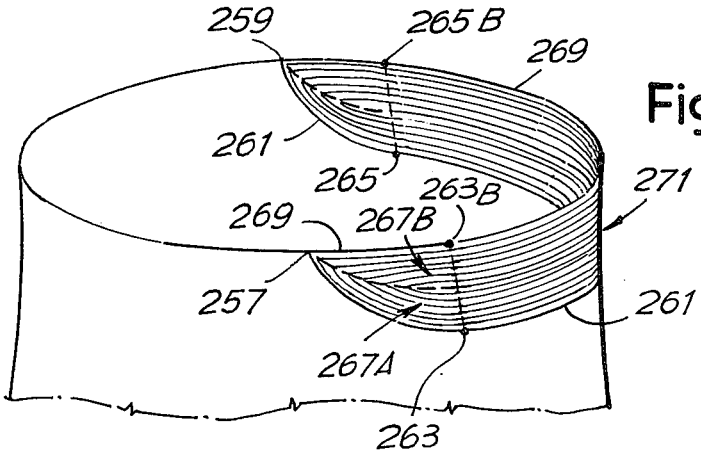
Figure 36:
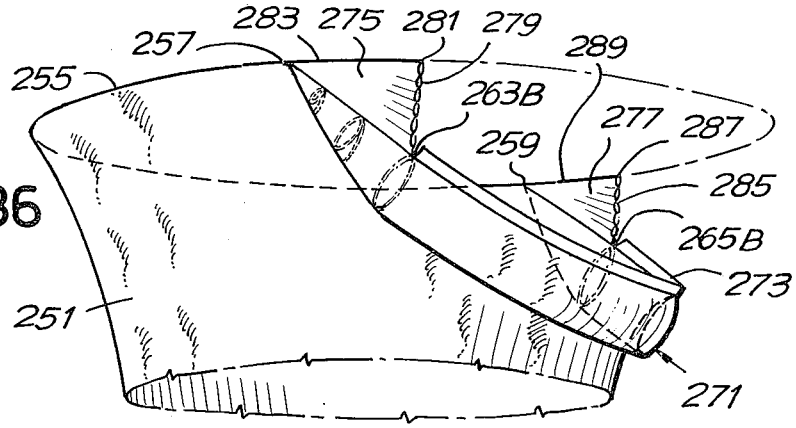
FIGS. 36, 37 and 38 illustrate additional forming stages of the articles and the completed article.
Figure 37:
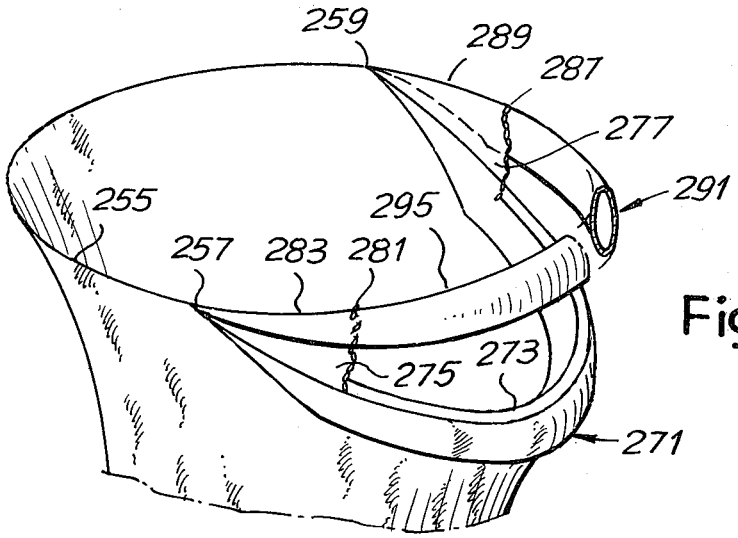
Figure 41:
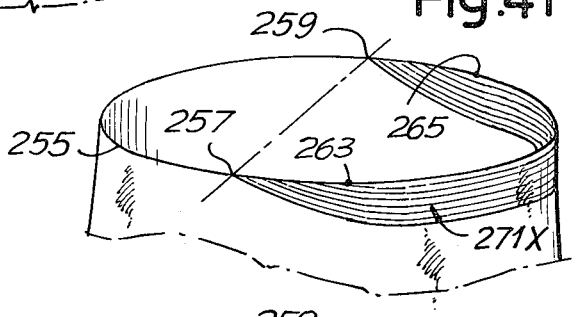
FIGS. 41 and 42 illustrate, similar to FIG. 35, additional variations of an embodiment.
Figure 42:
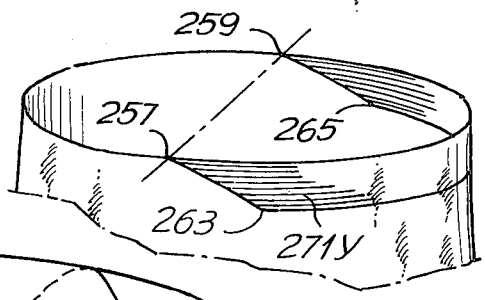

In FIGS. 34 and 35 where the pocket 271 is shown in fabrics 267A, 267B extended for clarity of understanding, the fabric for these welts is formed first by reducing the courses and then increasing them. It is possible also to proceed in the reverse manner, that is by first increasing the courses from the point 263 to the point 257 and from the point 265 to the point 259, and then reducing them. It is also possible to proceed only with a reduction of the width of the courses as shown in FIG. 41, where the fabric 271X for the forming of the welts is entirely made with only progressive reductions of the width of the courses. In FIG. 42, on the contrary, the fabric 271Y for the forming of the welt 271 is made only with courses from the points 263 and 265 toward the points 257 and 259.

Figure 43:
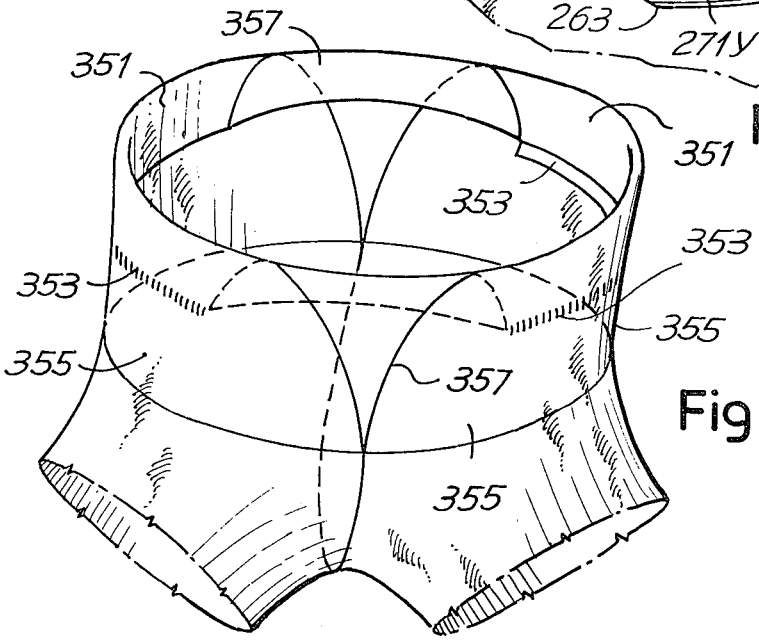
FIG. 43 is a perspective illustration of still another variation of embodiment.

FIG. 43 shows a variation of embodiment wherein the welt edges 351 are formed with connection lines 353 in an intermediate position on the flaps 355 formed with a reciprocating motion and with a trapezoidal development adjacent triangular fabrics 257 which are folded on themselves.

Additional variations may also be conceived by those skilled in the art within the scope of the following claims.

What is claimed is:

1. A knit construction for the waist portion of one-piece panty hose comprising a pair of tubular welts extending transversely of the direction of knitting and defining a waist opening therebetween, and at least one triangular reinforcing panel between said welts.

2. A process for forming a continous tubular one-piece panty hose on a circular knitting machine having a plurality of knitting needles arranged in a needle cylinder and a plurality of cooperatively arranged dial hooks, said process comprising forming a waist opening during knitting transverse to the direction of knitting, forming first and second tubular welts extending from the marginal edges of the waist opening, said tubular welts being successively formed by reciprocatory knitting and with gradual variations of the length of the courses in each said welt.

3. A process according to claim 2 wherein in the successive knitting of the said first and second tubular welts, the needles along one arc of the needle cylinder are raised out of operation with stitches retained thereon to support the panty hose being knit along a line which in use corresponds to the crotch line while the needles along a second arc of needles are actuated for reciprocal knitting, engaging the stitches on the needles of said second arc with dial hooks and supporting the fabric being knit by the needles in said second arc on the dial hooks during the successive formation of the said tubular welts.

4. A process according to claim 3 wherein during the successive knitting by reciprocal motion of said first and second tubular welts a portion of the needles in said working arc of needles are gradually excluded from the work starting from the ends of the working arc and extending toward the intermediate part of the working arc to form first and second tubular welts with tapered end portions.

5. A process according to claim 3 wherein after knitting said first tubular welt two triangles of fabric are formed along the tapered end portions of the first tubular welt with a reciprocating motion of the needle cylinder and with a progressive reduction of the number of active needles, and then forming the second tubular welt with progressive additions of actives needles corresponding to the inclined edges of said triangles bordering said second tubular welt.

6. A process according to claim 5 wherein the inclined edges of the fabric triangles are coextensive with and connected to the corresponding edge portions of the tubular welts.

7. A process according to claim 2 wherein the needles along a first arc are raised out of operation to retain the panty hose being knit along the crotch line while supporting the remaining fabric on dial hooks and knitting a first tubular welt with a reciprocating motion of the needle cylinder and with a variation of the length of courses to define tapered end portions on said tubular welt, forming an anti-ravel tab on said first tubular welt and discharging said first tubular welt from the needles, and forming a second tubular welt by reciprocal knitting with tapered end portions symmetrical to the tapered end portions on said first tubular welt.

* * * * *